United States Patent [19]

Berendt et al.

[11] Patent Number: 4,515,596

[45] Date of Patent: May 7, 1985

[54] PROCESS FOR AFTERTREATING DYED FIBROUS MATERIAL MADE OF OR CONTAINING CELLULOSE

[75] Inventors: Hans-Ulrich Berendt, Allschwil; Marielise Pacher, Reinach, both of Switzerland

[73] Assignee: Ciba-Geigy Corporation, Ardsley, N.Y.

[21] Appl. No.: 514,071

[22] Filed: Jul. 15, 1983

[30] Foreign Application Priority Data

Jul. 27, 1982 [CH] Switzerland ..... 4558/82
May 9, 1983 [CH] Switzerland ..... 2522/83

[51] Int. Cl.[3] ..... D06L 3/02; D06P 3/40; D06P 5/02

[52] U.S. Cl. ..... 8/107; 8/543; 8/584; 8/650; 8/918; 8/549; 252/180; 252/186.25; 252/186.28

[58] Field of Search ..... 252/180, 186.28; 8/107, 8/543, 650, 584

[56] References Cited

U.S. PATENT DOCUMENTS

| | | | |
|---|---|---|---|
| 3,122,417 | 2/1964 | Blaser et al. | 252/94 |
| 3,562,169 | 2/1971 | Prentice | 252/545 |
| 3,621,081 | 11/1971 | Prentice | 252/545 |
| 3,860,391 | 1/1975 | Kling et al. | 8/111 |
| 4,029,696 | 6/1977 | Sommer et al. | 252/180 |
| 4,061,695 | 12/1977 | Tai et al. | 252/80 |
| 4,201,669 | 5/1980 | Becker et al. | 252/180 |
| 4,253,912 | 3/1981 | Becker et al. | 162/76 |
| 4,253,969 | 3/1981 | Becker et al. | 252/180 |
| 4,254,063 | 3/1981 | Becker | 260/931 |
| 4,265,776 | 5/1981 | Gohla et al. | 252/174.16 |
| 4,337,214 | 6/1982 | Rohlfs et al. | 8/111 |
| 4,347,149 | 8/1982 | Smith et al. | 252/102 |

FOREIGN PATENT DOCUMENTS

| | | |
|---|---|---|
| 29076 | 5/1981 | European Pat. Off. . |
| 82823 | 6/1983 | European Pat. Off. . |
| 2828416 | 1/1979 | Fed. Rep. of Germany . |
| 56-37387 | 4/1981 | Japan . |
| 57-16983 | 1/1982 | Japan . |
| 57-61783 | 4/1982 | Japan . |
| 927617 | 5/1963 | United Kingdom . |

OTHER PUBLICATIONS

Chemical Abstract, vol. 84, (1976), No. 152110h.
Chemical Abstract, vol. 94, (1981), No. 210243y.
Chemical Abstract, vol. 96, (1982), No. 182690n.
Chemical Abstract, vol. 97, (1982), No. 93876f.

*Primary Examiner*—A. Lionel Clingman
*Attorney, Agent, or Firm*—Edward McC. Roberts; Kevin T. Mansfield

[57] ABSTRACT

Dyed fibrous materials made of or containing cellulose which were not bleached before dyeing are aftertreated in a combined bleaching and washing bath which can, optionally, contain as stabilizers derivatives of phosphonic or phosphorous acid, optionally as a combination with polyhydroxy compounds. The resulting materials have bright and brilliant shades.

This aftertreatment makes it possible to by-pass the otherwise customary, time-consuming and expensive drying of the materials between a bleach before dyeing and the dyeing itself.

19 Claims, No Drawings

PROCESS FOR AFTERTREATING DYED FIBROUS MATERIAL MADE OF OR CONTAINING CELLULOSE

The present invention relates to a process for aftertreating dyed fibrous materials made of or containing cellulose.

Before being dyed, fibrous materials made of or containing cellulose are subjected to a bleach with, for example, hydrogen peroxide in an alkaline medium. Thereafter the bleached material is dried and dyed and is then given the final wash.

The overall pretreatment of the material comprises a large number of steps, for example washing, bleaching and drying, which are time-consuming and expensive, and, for example, by-passing or eliminating such steps would significantly shorten the method and improve its economics.

The object of the invention is therefore to simplify the processing sequence of pretreatment (scouring and/or bleaching), dyeing and aftertreatment, for materials made of or containing cellulose. This object can be achieved in a novel manner if the processing sequence is altered to eliminate expensive drying steps and combine bleaching and washing into one step.

It was found, then, that fibrous materials made of or containing cellulose can be dyed without a pretreatment, i.e. in the grey or unbleached state, and then be finished in a combined bleaching and washing bath which can, optionally, also contain special stabilisers. The dyeing can therefore generally only be carried out with dyes which are stable in this combined bleaching and washing bath.

The invention thus relates to a process for aftertreating vat-, direct- or reactive-dyed fibrous materials made of or containing cellulose, which comprises treating the dyed fibrous materials in a combined bleaching and washing bath.

The invention also relates to this combined bleaching and washing bath, to its use in aftertreating vat-, direct- or reactive-dyed fibrous materials made of or containing cellulose, and to the aftertreated fibrous material made of or containing cellulose.

The fibrous material made of or containing cellulose and treated in a novel manner after the dyeing can be at many different stages of processing, for example in the form of loose fibre, yarn or woven or knitted fabric. The material treated in the process of the invention is thus generally always textile fibrous material which is made of pure textile cellulose fibres or mixtures of these cellulose fibres with textile synthetic fibres.

Examples of possible cellulose fibres are those made of regenerated cellulose, such as staple viscose or filament viscose, and those made of native cellulose, for example hemp, linen, jute and in particular cotton, and possible synthetic fibres are those made of polyacrylonitrile and in particular polyester and polyamide.

Fibrous materials made of or containing cellulose and used in the manner of the invention are dyed with vat, direct or reactive dyes in the customary liquors.

All customary vat dyes, without exception, are suitable, since they are stable in the bleaching and washing baths of the invention. It is thus possible to use, for example, anthraquinonoid vat dyes, for example acylamidoanthraquinones, anthraquinonecarbazoles, anthraquinoneimidazoles, indanthrones or benzanthrones, indigoid vat dyes, for example thioindigo or naphthoindigo, or phthalocyanines.

Suitable direct dyes, because they are stable in the bleaching liquors of the invention, are in particular, for example, disazo and polyazo dyes, but also monoazo dyes, and thiazole and quinoneimine dyes.

However, reactive-dyed fibrous materials made of or containing cellulose are of particular interest. Examples of reactive dyes suitable for the process of the invention are oxazine, triphenylmethane, xanthene, nitro, acridone, stilbene, perinone, peridicarboximide, quinophthalone, naphthoquinoneimine and phthalocyanine dyes, but, in particular, acidic anthraquinone and anionic azo dyes. The latter can be metal-free, metallisable or heavy metal complexes of monoazo, bisazo or polyazo dyes, including 1:2 chromium or cobalt complexes which contain two identical or different azo dye molecules complexed to a chromium or cobalt atom, and copper- or nickel-containing formazan dyes if they have substituents which are capable of forming a covalent bond with natural or synthetic cellulose fibres. These reactive groups can be bonded to the chromophoric part of the dye, preferably to an aromatic ring, either directly or via bridging members, such as oxygen, sulfur or an imino, methyleneimino, carbonylimino, sulfonylimino or ureylene group, optionally the imino hydrogen can be substituted by a methyl group.

Specific examples of such reactive groups are epoxy groups, ethyleneimino groups, isocyanate and isothiocyanate groups, aryloxycarboximino groups, the radical of an acid which has at least one mobile halogen atom and/or a multiple bond capable of addition, for example chloroacetic acid, bromoacetic acid, β-chloropropionic acid, β-bromopropionic acid, α,β-dibromopropionic acid, or atetrahalogenocyclobutanecarboxylic acid, such as 2-chloro-2-fluoro-B 3,3-difluoro- or 2,2,3,3-tetrafluoro-cyclobutane-1-carboxylic acid, propiolic acid, acrylic acid, methacrylic acid, α-chloroacrylic, β-chloroacrylic, α-bromoacrylic or β-bromoacrylic acid, α,β- or β,β-dichloroacrylic or -dibromoacrylic acid, trichloroacrylic or tribromoacrylic acid, 2-(2,2,3,3-tetrafluorocyclobut-1-yl)-acrylic acid, crotonic acid, α- or β-chlorocrotonic or -bromocrotonic acid, α,β-dichlorocrotonic acid, maleic acid, monochloromaleic or monobromomaleic acid, dichloromaleic or dibromomaleic acid, fumaric acid, monochlorofumaric or monobromofumaric acid, dichlorofumaric or dibromofumaric acid, monofumarates, dichlorosuccinic or dibromosuccinic acid, vinylsulfonic acid, β-chlorovinylsulfonic acid and a nitrohalogenobenzoic or nitrohalogenobenzenesulfonic acid having a mobile halogen atom, in particular having fluorine or chlorine in the o- or p-position relative to the nitro group, such as the radical of 3-nitro-4-fluorobenzoic acid and 3-nitro-4-fluorobenzenesulfonic acid, and also β-hydroxyalkylsulfonyl, β-hydroxyalkylsulfonamido or β-hydroxyalkylcarboxamido groups which are esterified with strong acids, such as the β-halogenoethylsulfonyl, β-sulfatoethylsulfonyl, β-sulfatoethylsulfamoyl, β-sulfatoethyl-N-methylsulfonamido or β-sulfatopropionamido group, or the β-alkyl- or β-phenylsulfonylalkyl-sulfonyl, -sulfonamido or -carboxamido group, for example the β-phenylsulfonylpropionamido group.

The reactive group preferably consists of the radical of an aromatic heterocyclic nitrogen compound which advantageously has more than one ring hetero-atom and which has at least one mobile halogen atom, such as fluorine, chlorine or bromine, or an acryloyl, N-hydroxymethyleneamino, sulfonic acid or alkylsulfonyl group on a ring carbon.

Specific examples of such reactive groups are the triazinyl or diazinyl radical having at least one mobile halogen atom, for example the radical of cyanuric fluoride, chloride or bromide or primary condensation products thereof in which a halogen atom has been replaced by the substituted or unsubstituted radical of a primary or secondary aliphatic, alicyclic, aromatic or heterocyclic amine, in particular by aniline or its alkyl, sulfonic acid or carboxylic acid derivatives, by lower monoalkylamines or dialkylamines, or by ammonia, or by the radical of an aliphatic, alicyclic, aromatic or heterocyclic hydroxy or thiol compound, and the di- or trihalogenopyrimidyl radical, such as the 2,4-di- or, in particular, 2,4,5-trichloro-, -tribromo- or -trifluoro-, 5-bromo- or 5-chloro-2,4-difluoro- or 5-bromo-2,4-dichloropyrimid-6-yl radical. The dihalogenopyrimidyl radical can carry in the 5-position for example the following substituents: methyl, ethyl, carboxamide or sulfonamide which can be substituted at the nitrogen atom, methyl or ethyl carboxylates, acyl, for example carboxymethyl, chloromethyl or bromomethyl.

Further examples of possible reactive groups are the radical of a dihalogenopyrimidinecarboxylic acid, of 2,3-dihalogenoquinoxalinecarboxylic or 2,3-dihalogenoquinoxalinesulfonic acid, of 2-halogeno- or 2-methylsulfonyl-benzothiazole- or -oxazole-carboxylic or -sulfonic acid, of 1,4-dihalogenophthalazinecarboxylic acid, of 2,4-dihalogenoquinazolinecarboxylic acid or of 4,5-dihalogeno-6-pyridazon-1-yl-alkylenecarboxylic or -phenylenecarboxylic acid, such as the acid radicals of 2,4-difluoropyrimidine- or 2,4-dichloropyrimidine-5- or -6-carboxylic acid, 2,4-dichloro-6-chloromethylpyrimidine-5-carboxylic acid, 2,3-difluoroquinoxaline- or 2,3-dichloroquinoxaline-6-carboxylic acid or -6-sulfonic acid, 2-chlorobenzothiazole- or 2-chlorobenzoxazole-5- or -6-carboxylic acid or -5- or -6-sulfonic acid, 1,4-difluorophthalazine-, 1,4-dichlorophthalazine- or 1,4-dibromophthalazine-6-carboxylic or -6-sulfonic acid, 2,4-dichloroquinazoline-6- or -7-carboxylic acid, 2,3-dichloroquinoxaline-7-carboxylic or -7-sulfonic acid or 4,5-dichloro-6-pyridazon-1-yl-trimethylenecarboxylic or -1',4'-phenylenecarboxylic acid.

Other specific examples of reactive groups are trichloropyridazinyl, dichloro-1,2,4-triazinyl, 3-chloropyridazine-6-carboxylic acid, 5-chloro-1,2,4-thiadiazol-3-yl-1',4'-phenylenecarboxylic acid, allylsulfonyl and allylthio radicals. Reactive "onium dyes" should also be mentioned, which in place of, for example, a reactive halogen atom or an ester group carry a reactive ammonium, quinuclidinium, pyridinium, hydrazinium or sulfonium radical.

Dyes which are particularly suitable for the process of the invention are those whose reactive groups derive from halogenotriazines.

Some of the reactive dyes can be in the form of the free acid, but they are preferably in the form of an alkali metal salt, for example the lithium, sodium or potassium salt, or an ammonium salt.

The aqueous dyeing liquors, in addition to the dyes mentioned, also contain, as is customary, one or more non-ionic and/or anionic surfactants.

Examples of suitable anionic surfactants are sulfated adducts of 1 to 10 mols of ethylene oxide onto higher fatty acids, higher aliphatic alcohols and alkylphenols whose alkyl chain contains 8 to 20 carbon atoms, alkyl sulfonates having 10 to 20 carbon atoms in the alkyl chain, and alkylbenzenesulfonates having a straight or branched alkyl chain with 8 to 20 carbon atoms in the alkyl chain.

Non-ionic surfactants, however, are preferable, for example polyglycol ethers of alkylated phenols having at least 7 carbon atoms in the alkyl chain and 4 to 30 alkyleneoxy groups, or N-acylated alkanolamines, alkyl polyglycol ethers having 10 to 18 carbon atoms in the alkyl chain and 5 to 20 ethyleneoxy groups, or polyglycol ethers having a basic nitrogen.

It was also found to be particularly advantageous to add water-soluble aldehyde condensation products which contain basic nitrogen and which advantageously derive from lower aliphatic aldehydes and ammonia or lower amines. The preferred condensation product is hexamethylenetetramine.

The aqueous dyeing liquors can also contain additives customary in dyeing and printing, for example thickeners, electrolytes, bases, urea, thiourea, thiodiethylene glycol and hydrophilic compounds of limited solubility in water, for example butyl or benzyl alcohol. It is also possible to add to the aqueous liquor compounds which speed up the reaction between dye and fibre, such as tertiary amines or hydrazine compounds having at least one tertiary nitrogen atom.

The amounts of substances to be added to the dyebaths in the process of the invention can vary within relatively wide limits. The amount of dye depends on the desired depth of shade and is generally between 0.01 and 8% on weight of fibre. Non-ionic or anionic surfactants and other dyeing assistants are generally each added in amounts of 0.01 to 4% on weight of fibre.

The combined bleaching and washing bath can, optionally, also contain stabilisers which prevent any sedimenting or scaling in the bath. Examples of suitable stabilisers are the derivatives of phosphonic acid. It is possible to use, for example, (a) adducts of aminoalkanediphosphonic acids and epihalogenohydrins, which have the formula

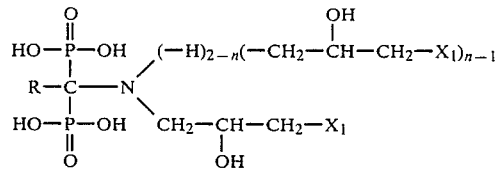

(1)

The compounds of the formula (1) are preferably in the form of their alkali metal salts, for example sodium salts or potassium salts. R in the formula (1) is alkyl having 1 to 4 carbon atoms, for example methyl, ethyl, propyl, butyl, isopropyl or isobutyl. Methyl is particularly preferred. $X_1$ is halogen, preferably iodine, bromine or, in particular, chlorine. n is 2 or, preferably, 1.

A further group of suitable stabilisers are (b) those of the formula

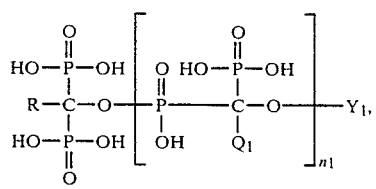

(2)

which optionally can be in the form of a magnesium complex.

In these phosphonate oligomers of the formula (2), which are preferably in the form of their alkali metal salts, for example sodium salts or potassium salts, $Y_1$ is hydrogen or a radical of the formula $-COT_1$, where $T_1$ is alkyl having 1 to 4 carbon atoms. R and $Q_1$ likewise are alkyl having 1 to 4 carbon atoms. Examples of suitable alkyl radicals for $T_1$, $R_1$ and $Q_1$ are methyl, ethyl, propyl, butyl, isopropyl and isobutyl. Methyl is particularly preferred. $n_1$ is an integer from 1 to 16. The oligomers are present as a mixture in which those of average molecular weight, i.e. with $n_1$ equal to 5 to 9, predominate. Low molecular weight oligomers with, for example, $n_1$ equal to 1 and high molecular weight oligomers with, for example, $n_1$ equal to 12 to 16, however, are always present in the mixture in minor amounts.

Other particularly suitable (b) stabilisers are magnesium complexes of the oligomers of the formula (2), in which the molar ratio of phosphonate to magnesium ($Mg^{2+}$) is preferably 1:0.1 to 1:4.5. The good bleaching action of a bleaching liquor containing one of these magnesium complexes is retained even above pH 11 provided a polyhydroxy compound has been added to the liquor.

Reaction products of phosphorous acid and carboxylic acid anhydrides or halides, labelled (c), are also suitable for use as stabilisers for the combined bleaching and washing bath. These reaction products are obtained by reacting phosphorous acid with a carboxylic anhydride or halide in a molar ratio of 1:(1 to 1.5). These reaction products are also preferably used in the form of alkali metal salts, for example sodium salts or potassium salts. The carboxylic acid radical in the acid anhydride or aryl halide contains 2 to 4 carbon atoms. Starting materials are thus the anhydride or a halide, in particular the chloride or bromide, of acetic acid, propionic acid, butyric acid or isobutyric acid. Anhydrides are preferred to halides.

It is also possible to use a mixture of two or more stabilisers selected from one of the groups (a) or (b) or (c) in the combined bleaching and washing bath [(d)HD 1]. Optionally, it is also possible to use mixtures which comprise stabilisers selected from at least two of the groups (a), (b) and (c) [for example stabiliser(s) (a) with stabiliser(s) (b)][$(d)_2$].

It can be advantageous to use said stabilisers (a), (b), (c), $(d)_1$ and $(d)_2$ in the form of a combination with polyhydroxy compounds.

A polyhydroxy compound is for example a compound which contains at least 2 hydroxyl groups. These compounds preferably have the formula $$R_1-\left(\begin{array}{c}CH\\|\\OH\end{array}\right)_x-R_2 \qquad (3)$$

in which $R_1$ and $R_2$, independently of each other, are $-CH_2OH$, $-CHO$ or $-CO_2M$, M is hydrogen or an alkali metal, preferably sodium, and x is 2 to 5.

Hydroxycarboxylic acids of the formula $$HO-CH_2-\left(\begin{array}{c}CH\\|\\OH\end{array}\right)_x-CO_2M, \qquad (4)$$

in which M and x are as defined above, or a lactone thereof are particularly suitable. Gluconic acid and its alkali metal salts, preferably the sodium salt, and also the γ-lactone of gluconic acid also give particularly good results. 0.1 to 10 mols of polyhydroxy compound can preferably be used per mol of stabiliser. Suitable bleaching liquors thus contain per liter 0.01 to 6 g of polyhydroxy compound.

Compounds of the formula (1) are prepared by reacting a compound of the formula $$\begin{array}{c}O\\\|\\HO-P-OH\\|\\R_1-C-NH_2,\\|\\HO-P-OH\\\|\\O\end{array} \qquad (5)$$

in which $R_1$ is alkyl having 1 to 4 carbon atoms, in an aqueous medium in the presence of an alkali metal hydroxide, with an epihalogenohydrin, and optionally converting the resulting alkali metal salt into the free acid by means of an acidic cation exchange resin.

To prepare compounds of the formula (1), at least 4 mols of an alkali metal hydroxide and 1 to 1.1 mols or 2 to 2.2 mols of an epihalogenohydrin are used per mol of starting compound of the formula (5), and the reaction is carried out at 20° to 90° C. in the course of 2 to 8 hours, optionally under reduced pressure (−10 to −50 bar) during the last ½ to 1 hour. The alkali metal hydroxide used is preferably sodium hydroxide or, in particular, potassium hydroxide, and the starting compounds of the formula (5) are converted into the corresponding tetraalkali metal salts. If n in the formula (1) is 2, 2 to 2.2 mols of epihalogenohydrin are preferably used per mol of starting compound of the formula (5), and if n is 1, the amount of epihalogenohydrin is in particular 1 to 1.1 mols. A suitable epihalogenohydrin is in particular epibromohydrin or especially epichlorohydrin.

The compounds obtained in the form of alkali metal salts are generally converted into the free acids of the formula (1) by mixing with excess cation exchange resin at room temperature (15° to 25° C.) and then separating off the resin by filtration. However, this optional measure is generally not necessary, since the compounds of the formula (1) are used in combined bleaching and washing baths which are alkaline.

Oligomers of the formula (2) and their preparation are known per se and are described, for example, by U.S. Pat. No. 4,254,063 and EP-A-0,029,076. These known methods of preparation give the oligomer mixtures in the form of their free phosphonic acids. However, it is advantageous, before they are used in the alkaline bleaching and washing bath, to convert at least some of the oligomers, into their alkali metal salts. This conversion is generally carried out by adding an alkali metal hydroxide to the aqueous solutions of the oligomers. These solutions, then, are admixed with enough, for example, sodium hydroxide or potassium hydroxide for their pH-value to rise to 3 to 7. Because they are more soluble, the potassium salts of the oligomers are preferred to the sodium salts.

The magnesium complexes of oligomers of the formula (2) are prepared by reacting a, preferably, aqueous solution of said oligomers with a water-soluble magnesium salt, for example magnesium acetate, sulfate or oxide or, preferably magnesium chloride. The oligomer solutions used generally contain 30 to 55, preferably 35, % by weight of phosphonate. Magnesium chloride is usually used in the form of its hexahydrate ($MgCl_2 \times 6H_2O$), but it is also possible to use magnesium chloride having a lower water content or anhydrous magnesium chloride. The molar ratio of phosphonate to magnesium ($Mg^{2+}$) is preferably 1:0.1 to 1:4.5. A molar ratio of 1:0.5 to 1:3.0 is particularly suitable. (The molecular weight of the phosphonates is arbitrarily taken as 394, which means for compounds of the formula (1) that $n_1$ is 1, $R_1$ and $Q_1$ are methyl, and $Y_1$ is hydrogen.) It is advisable to cool the reaction system to conduct away the heat of reaction resulting from the preparation of the magnesium complexes.

In the preparation of (c) reaction products 1.2 mols of halides or anhydrides of the specified type are preferably used per mol of phosphorous acid. Equimolar amounts of the two starting materials, however, remain to the fore of interest. The reaction is generally carried out in the melt at elevated temperatures to reflux temperatures, i.e. at about 60° to 190° C. The optional, if desired partial, conversion of reaction products which can be obtained in this way is accomplished by adding an alkali metal hydroxide after the reaction has ended. The aqueous reaction solutions are then at a pH-value of from 3 to 7.

The combined bleaching and washing bath of the invention, in addition to said stabilisers (a) to $(d)_2$, which can be present in a combination with polyhydroxy compounds of, for example, the formula (3), also can contain the constituents otherwise customary for bleaching baths:

(e) an alkali metal hydroxide,
(f) hydrogen peroxide
and, optionally, as further additives
(g) a peroxosulfate,
(h) a wetting agent,
(i) a defoaming and/or deaerating agent and/or
(j) silicic acid or its alkali metal salts.

Potassium hydroxide and especially the less expensive sodium hydroxide, as component (e), and hydrogen peroxide, as component (f), are primarily used in the form of their aqueous, preferably concentrated (about 30 to 35 percent by weight) solutions, but component (e) can also be used in the form of a solid, for example in the form of solid sodium hydroxide.

Component (g) is preferably an alkali metal peroxosulfate or, in particular, sodium peroxodisulfate ($Na_2S_2O_8$), which is preferably used in the form of a solid.

A wetting agent for use as component (h) is an anionic or non-ionic surfactant, but in particular a mixture of these two types of surfactant. Examples of preferred anionic surfactants are alkylsulfonates, alkylarylsulfonates, fatty acid condensation products, protein breakdown products or salts thereof, and especially alkylsulfate salts and alkylbenzenesulfonic acids having 12 to 22 carbon atoms in the alkyl radical. Examples of preferred non-ionic surfactants are adducts of alkylene oxides, especially propylene oxide or in particular ethylene oxide, and alkylphenols having, for example, 4 to 12 carbon atoms in the alkyl radical, especially fatty acid amides or in particular fatty alcohols, adducts of ethylene oxide and fatty alcohols being particularly preferred and being to the fore of interest in the form of their mixture with the alkylsulfates and alkylbenzenesulfonic acids of the specified type.

Component (i) is preferably a higher alcohol, for example isooctyl alcohol, or especially a silicone-based defoaming and/or deaerating agent, in particular a silicone oil emulsion.

Components (h) and (i) are preferably combined with commercially available, aqueous, approximately 10 to 60, preferably 30 to 40, percent by weight formulations of nonfoaming surfactant mixtures.

Component (j) is for example an alkali metal salt of silicic acid, in particular sodium silicate, especially in the form of an aqueous solution which contains about 25 to 30% by weight of silicate ($SiO_2$).

The combined aqueous bleaching and washing bath of the present invention generally contains per liter 0.03 to 5 g of stabiliser (a), (b), (c), $(d)_1$ or $(d)_2$, optionally in combination with 0.01 to 6 g of polyhydroxy compound,
0.04 to 20 g of component (e),
0.3 to 68 ml of component (f) as a 35% solution,
0 to 10 g of component (g),
0 to 8 g of component (h),
0 to 0.02 g of component (i) and
0 to 1.2 g of component (j).

In concentrated form the combined bleaching and washing liquors of the invention can also be used in the wet-on-wet method. In this case the individual components in the liquor are up to, for example, 10 times more concentrated. These more concentrated liquors should preferably also contain raised stabiliser levels, for example per liter up to 50 g of stabilisers (a), (b), (c), $(d)_1$ or $(d)_2$, to stabilise the hydrogen peroxide.

To obtain superior wetting and penetration of the fibre material by the bleaching/washing liquor without, however, undesirable foaming, it is advantageous to have a commercially available formulation of component (h) present in the bleaching and washing bath, especially if combined with component (i), in addition to the components always present, namely (a), (b), (c), $(d)_1$ or $(d)_2$, and (e) and (f).

In addition to the components (a) to (f) or (a) to (f), (h) and (i), respectively, one can use component (g) and/or (j).

The novel process for aftertreating fibrous materials made of or containing cellulose by means of stabilisers (a) to $(d)_2$ is carried out by methods known per se. For instance, the bleaching/washing liquors are applied to the dyed fibre material in a known manner, generally by impregnating, for example, by dipping and preferably by padding at, for example, 10° to 60° C., but preferably at room temperature (15° to 25° C.) the liquor pick-up after squeezing being about 50 to 120, preferably 70 to 100, percent by weight or, in wet-on-wet, 10 to 50%. Impregnated by dipping or padding, the fibre material is generally subjected without drying, while still wet or, after the squeeze in the padding method, still moist, to a wet or moist batching method, in which the textile material is stored in the plaited or rolled-up state optionally wrapped up air-tight in plastic sheeting and optionally under pressure, at at most 150° C. for about 10 minutes, but preferably under atmospheric pressure at 80° to 98° C. for about 1 to 3 hours or, in particular, at room temperature (15° to 25° C.) for about 6 to 24 hours.

However, the dyed fibre materials can also be treated in long liquors (exhaust methods) at a liquor ratio of, for example, 3:1 to 100:1, preferably 8:1 to 25:1, at 20 to 100, preferably 80 to 98, °C. for 10 to 40 minutes. Exhaustion can also take place at up to 150° C. under pressure in high-temperature apparatus (HT apparatus). If the bleach is performed in the exhaust method, the fibre material is treated at the temperatures specified for the lengths of time specified in the apparatus used for the exhausting, for example in a winch.

In industrial operation it is continuous methods which are of main importance, and the length of time the fibre material has to remain in the bleaching liquor at a given temperature are similar.

Treatment temperatures of 98° C. are advantageously not exceeded, to preclude any fibre damage. In special HT apparatus, however, the fibre materials can be treated under a pressure of up to, for example, 2.5 bar at elevated temperatures, for example up to 150° C., even in industrial continuous methods, provided the length of the treatment is kept so short as to exclude the possibility of fibre damage.

The fibre materials are afterwards thoroughly rinsed, generally first with hot water at about 70° to 98° C. and then with cold water, and dried. The aftertreatment of the invention produces dyeings of the same quality as in conventional methods of dyeing, and that in a very economical manner. The invention eliminates the otherwise customary drying step after bleaching (and before dyeing), and thus substantially reduces, for example, water and energy consumption. This reduction is especially the case in the treatment of heavyweight goods, for example terry towelling.

The fibrous materials made of or containing cellulose which have been treated by the process of the invention exhibit dyeings which, in quality, are the equal of those obtained conventionally.

The following examples serve to illustrate the invention without in any way restricting the scope thereof. Parts and percentages are by weight, unless otherwise stated.

EXAMPLE 1

Cotton knitwear (grey goods; weight per square meter: 165 g) is padded in a dyeing liquor of the following composition (per liter): 4 g of dye of the formula

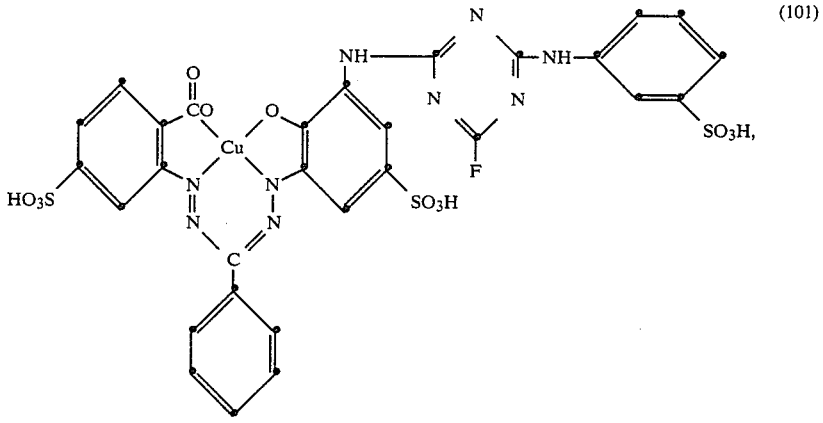

10 g of the sodium salt of an alkyl-($C_{15}$)-sulfonic acid, 5 ml of sodium hydroxide solution (30%) and 50 ml of sodium silicate (26.3–27.7% silicate content).

The temperature of the dyeing liquor is 25° C., and the liquor pick-up is 90%. After having been padded, the material is rolled up, is wrapped air-tight in a plastic sleeve, and is stored at 25° C. for 6 hours.

The dyed fabric is rinsed cold and then hot. It is then washed at 98° C. for 20 minutes with a washing liquor which contains per liter 2 g of a conventional detergent (an alkylphenol/ethylene oxide adduct), is then rinsed once more hot and cold and is dried at elevated temperatures.

A second piece of cotton fabric is dyed in the manner described. After the batching, however, the fabric is squeezed to reduce its liquor level to 70%. Immediately afterwards the dyed sample is padded with a bleaching-/washing liquor of the following composition (per liter): 3 g of the sodium salt of an alkyl-($C_{15}$)-sulfonic acid, 85 ml of hydrogen peroxide (35%), 45 ml of sodium hydroxide solution (30%) and 30 g of the stabiliser of the formula

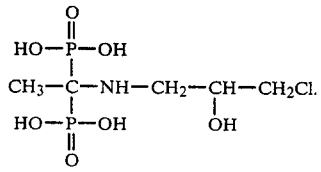

The temperature of the bleaching/washing liquor is 25° C., and the liquor level is raised by 30% from 70% to 100%. The dyed and bleached sample is rolled up, is packed air-tight into a plastic sleeve, and is stored at 25° C. for 24 hours. The sample is then rinsed and dried.

If the two resulting fabrics are compared with each other, the dyed and bleached fabric is found to have a markedly brighter, more brilliant blue shade than that of the unbleached dyed fabric.

Similar, good results are obtained with the other stabilisers, namely (a) to $(d)_2$.

EXAMPLE 2

Cotton knitwear (grey goods; weight per square meter: 165 g) is introduced into a warm dyeing liquor at 40° C. which contains per liter 40 g of calcined sodium sulfate, 2 g of the sodium salt of an alkyl-($C_{15}$)-sulfonic acid, 2 ml of sodium hydroxide solution (30%) and 0.4% of the dye of the formula

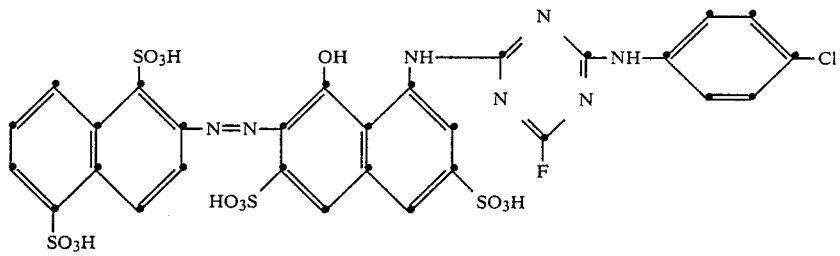

(103)

The liquor ratio is 40:1. After a dyeing time of 45 minutes, 1 g of calcined sodium carbonate is added per liter of the liquor, followed 5 minutes later by 2 ml of sodium hydroxide solution (30%) per liter of liquor. Afterwards the dyeing is continued for a further 40 minutes.

The dyed fabric is rinsed hot and cold. The fabric is then introduced into a washing liquor which contains per liter 1 g of an alkylphenol/ethylene oxide adduct and which is heated up to 90° C. in the course of 20 minutes. The dyeing is followed at this temperature by a 20-minute final wash. The fabric is then rinsed once more hot and cold and is dried.

A second piece is dyed and rinsed cold and hot, both steps being carried out as described above. It is then not washed but bleached with a bleaching liquor of the following composition (per liter): 5 ml of $H_2O_2$, 1 g of an alkylphenol/ethylene oxide adduct, 2.5 ml of sodium hydroxide solution (30%) and 1 g of the stabiliser of the formula (102).

This bleaching liquor, with the dyed fabric in it, is likewise heated up to 90° C. in the course of 20 minutes and is held at this temperature for 20 minutes. The fabric is then rinsed hot and cold and is dried.

The fabric bleached after dyeing has a significantly brighter and more brilliant red shade than the fabric only washed after dyeing.

The remaining stabilisers, namely (a) to $(d)_2$, gave similar, good results.

EXAMPLE 3

Cotton knitwear (grey goods; weight per square meter: 165 g) is padded in a dyeing liquor of the following composition (per liter): 4 g of dye of the formula (101), 10 g of the sodium salt of an alkyl-($C_{15}$)-sulfonic acid, 5 ml of sodium hydroxide solution (30%) and 50 ml of sodium silicate (26.3–27.7% silicate content).

The temperature of the dyeing liquor is 25° C., and the liquor pick-up is 90%. The padded fabric is rolled up, is packed air-tight into a plastic sleeve, and is stored at 25° C. for 12 hours. It is then rinsed cold and hot and is washed at 90° C. for 20 minutes in a washing liquor which contains per liter 2 g of an alkylphenol/ethylene oxide adduct. The fabric is then rinsed once more hot and cold and is dried.

A second piece is dyed and rinsed, both steps being carried out as described above. It is then not washed but bleached—for 20 minutes at 90° C.—with a bleaching liquor of the following composition (per liter): 5 ml of $H_2O_2$, 2 g of an alkylphenol/ethylene oxide adduct, 2.5 ml of sodium hydroxide solution (30%) and 1 g of stabiliser of the formula (102). The liquor ratio is 20:1. The fabric is then rinsed hot and cold and is dried.

The fabric bleached after dyeing has a markedly brighter and more brilliant blue shade than the fabric merely washed after dyeing.

Similar, good results are obtained with the remaining stabilisers, namely (a) to $(d)_2$.

EXAMPLE 4

Cotton terry towelling (grey state) is padded with a dyeing liquor of the following composition (per liter): 10 g of dye of the formula

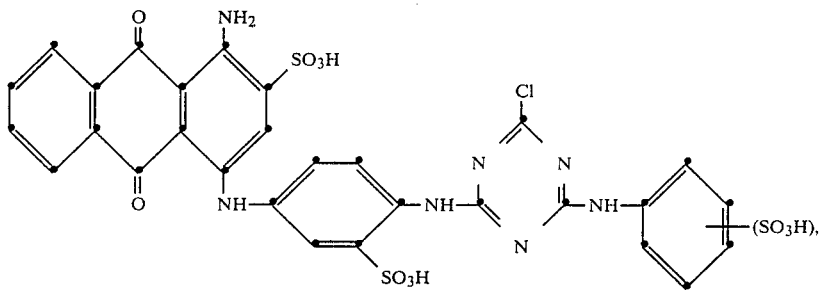

(104)

10 g of the sodium salt of an alkyl-($C_{15}$)-sulfonic acid, 100 ml of sodium hydroxide solution (30%) and 100 ml of sodium silicate (a 26.3–27.7% silicate content). The temperature of the liquor is 25° C., and the liquor pick-up is 90%. The padded fabric is rolled up, is packed air-tight into a plastic sleeve, and is stored at room temperature for 24 hours. It is then rinsed, washed, rinsed once more and dried, every step being carried out as described in Example 3.

A second piece is dyed and rinsed, both steps being carried out as described above. It is then not washed but bleached—for 20 minutes at 90° C.—with a bleaching liquor of the following composition (per liter): 2.5 ml of sodium hydroxide solution (30%), 5 ml of 35% hydrogen peroxide, 2 g of an alkylphenol/ethylene oxide adduct and 1 g of stabiliser of the formula (102). The fabric is then rinsed hot and cold and is dried.

The fabric bleached after dyeing was found to have a much brighter blue shade than the fabric merely washed after dyeing.

Similar, good results are obtained when the remaining stabilisers, namely (a) to $(d)_2$, are used.

EXAMPLE 5

100 g of cotton knitwear (grey state) are wetted out at 30° C. for 10 minutes in 2 liters of a liquor which contains 6 g of the sodium salt of an alkyl-($C_{15}$)-sulfonic acid. 1 ml of the compound of the formula (102), 1.2 ml of sodium hydroxide solution (30%), 5 ml of hydrogen peroxide (35%), 20 ml of sodium silicate (a 26.3–27.7% silicate content) and 0.05 g of the dye of the formula

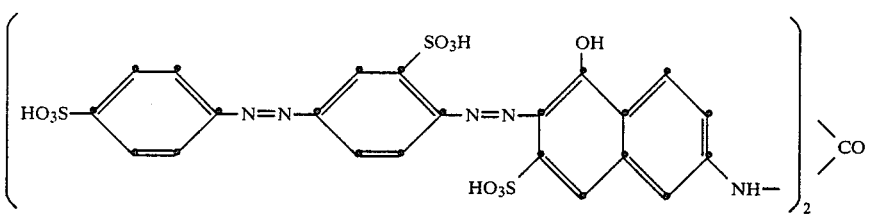

(105)

are then added to the liquor. This liquor is raised to 92° C. in the course of 30 minutes. 5 g of calcined sodium sulfate are then added. The fabric is dyed at 92° C. for 60 minutes and is then rinsed warm and cold, is neutralised and is rinsed again.

The knitwear is obtained with a brilliant red shade. Similar, good results are obtained with the other stabilisers, namely (a) to $(d)_2$.

EXAMPLE 6

Cotton knitwear (grey state; weight per square meter: 165 g) is padded at room temperature in a dyeing liquor of the following composition (per liter): 1 g of the dye of the formula

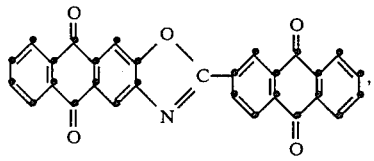

(106)

10 g of the sodium salt of an alkyl-($C_{15}$)-sulfonic acid, 20 ml of sodium hydroxide solution (30%), 10 ml of sodium silicate (a 26.3–27.7% silicate content), 40 ml of hydrogen peroxide (35%) and 10 ml of the compound of the formula (102). The liquor pick-up is 80%. After the padding the goods are stored at room temperature on rolls.

The goods are then developed at 50° C. in the course of 60 minutes in a liquor which contains per liter 8 ml of sodium hydroxide solution (30%), 4 g of sodium dithionite and 10 g of calcined sodium sulfate (a liquor ratio of 20:1). The knitwear is then rinsed, oxidised, rinsed again, soaped and dried.

The result is a bright, level red dyeing having very good fastness properties.

EXAMPLE 7

Cotton knitwear (grey state; weight per square meter: 165 g) is introduced into a warm dyeing liquor at 40° C. which contains per liter 40 g of sodium sulfate, 2 g of the sodium salt of an alkyl-($C_{15}$)-sulfonic acid and 0.4 g of the dye of the formula (103). 45 minutes later 1 g of sodium carbonate (calcined) is added per liter, followed 5 minutes later by 2 ml of sodium hydoxide solution (30%) per liter. The dyeing is then continued for a further 40 minutes (at 40° C.). The dyed fabric is then washed cold and hot.

Dyeing a: the resulting fabric is washed in an aqueous liquor (a liquor ratio of 40:1) which contains per liter 1 g of an ethoxylated nonylphenol. It is then rinsed hot and cold.

Dyeing b: the resulting fabric is bleached in an aqueous liquor (a liquor ratio of 40:1) which contains per liter 1 g of an ethoxylated nonylphenol, 2.5 ml of sodium hydroxide solution (30%), 5 ml of hydrogen peroxide (35%) and 1 g of a preparation of 100 parts of the compound of the formula (2), 54 parts of magnesium chloride (hexahydrate), 155 parts of sodium gluconate and 691 parts of water, by raising the liquor to 90° C. in the course of 30 minutes and keeping it at this temperature for 20 minutes. The fabric is then rinsed hot and cold.

Dyeing c: the resulting fabric is bleached in the manner shown for dyeing sample b in an aqueous liquor (a liquor ratio of 40:1) which contains per liter 1 g of an ethoxylated nonylphenol, 2.5 ml of sodium hydroxide solution (30%), 5 ml of hydrogen peroxide (35%) and 1 g of a preparation of 200 parts of the compound of the formula (2), 145 parts of magnesium chloride (hexahydrate), 155 parts of glucose and 500 parts of water. The fabric is then rinsed hot and cold.

Dyeings b and c have a markedly brighter and more brilliant red shade than dyeing a, which had merely been washed after dyeing.

EXAMPLE 8

Cotton knitwear (grey state; weight per square meter: 165 g) is padded with a dyeing liquor of the following composition (per liter): 4 g of dye of the formula (101), 10 g of a sodium salt of an alkyl-($C_{15}$)-sulfonic acid, 5 ml of sodium hydroxide solution (30%) and 50 ml of sodium silicate (a 26.3–27% silicate content).

The temperature of the liquor is 25° C., and the liquor pick-up is 90%.

The padded fabric is rolled up, is packed air-tight into a plastic sleeve, and is stored at room temperature for 24 hours. It is then rinsed hot and cold.

Dyeing a: the resulting fabric is washed in an aqueous liquor (a liquor ratio of 40:1) which contains per liter 2 g of an ethoxylated nonylphenol. It is then rinsed hot and cold.

Dyeing b: the resulting fabric is bleached in an aqueous liquor (a liquor ratio of 40:1) which contains per liter 2 g of an ethoxylated nonylphenol, 2.5 ml of sodium hydroxide solution (30%), 5 ml of hydrogen peroxide (35%) and 1 g of a preparation of 100 parts of the compound of the formula (2), 54 parts of magnesium chloride (hexahydrate), 155 parts of sodium gluconate and 691 parts of water, by raising the liquor to 90° C. in the course of 30 minutes and holding it at this temperature for 20 minutes.

Dyeing c: the resulting fabric is bleached in the same manner as dyeing b in an aqueous liquor (a liquor ratio of 40:1) which contains per liter 2 g of an ethoxylated nonylphenol, 2.5 ml of sodium hydroxide solution (30%), 5 ml of hydrogen peroxide (35%) and 1 g of a preparation of 200 parts of the compound of the formula (2), 145 parts of magnesium chloride (hexahydrate), 155 parts of glucose and 500 parts of water. It is then rinsed hot and cold.

The bleached dyeings b and c have a brighter and more brilliant blue shade than dyeing a, which was merely washed after dyeing.

EXAMPLE 9

Cotton terry towelling (grey state; weight per square meter: 420 g) is padded with a dyeing liquor of the following composition (per liter): 10 g of dye of the formula (104), 100 ml of sodium hydroxide solution (30%), 10 g of a sodium salt of an alkyl-($C_{15}$)-sulfonic acid and 100 ml of sodium silicate (a 26.3–27% silicate content). The liquor pick-up is 90%. The padded fabric is rolled up, is packed air-tight into a plastic sleeve, and is stored at room temperature for 24 hours. It is then rinsed hot and cold.

Dyeing a: the resulting fabric is washed at 90° C. for 20 minutes in an aqueous liquor (a liquor ratio of 40:1) which contains per liter 2 g of an ethoxylated nonylphenol. It is then rinsed hot and cold.

Dyeing b: the resulting fabric is bleached in an aqueous liquor (a liquor ratio of 40:1) which contains per liter 2 g of an ethoxylated nonylphenol, 2.5 ml of sodium hydroxide solution (30%), 5 ml of hydrogen peroxide (35%) and 1 g of a preparation of 100 parts of the compound of the formula (2), 54 parts of magnesium chloride (hexahydrate), 155 parts of sodium gluconate and 691 parts of water, by raising the liquor to 90° C. in the course of 30 minutes and holding it at this temperature for 20 minutes.

The bleached dyeing b has a significantly brighter and more brilliant blue shade than dyeing a, which was merely washed after dyeing.

EXAMPLE 10

Cotton knitwear (grey state; weight per square meter: 165 g) is padded with a dyeing liquor of the following composition (per liter): 4 g of dye of the formula (101), 10 g of a sodium salt of an alkyl-($C_{15}$)-sulfonic acid, 5 ml of sodium hydroxide solution (30%) and 50 ml of sodium silicate (a 26.3–27% silicate content). The temperature of the liquor is 25° C., and the liquor pick-up is 90%.

Dyeing a: the padded fabric is rolled up, is packed air-tight and is stored at room temperature for 6 hours. After this cold batching it is rinsed cold and hot and is washed at 98° C. for 20 minutes with a liquor which contains per liter 2 g of an ethoxylated nonylphenol. It is then rinsed hot and cold.

Dyeing b: after the padding the liquor pick-up is reduced from 90% to 70%. The fabric is then padded with a bleaching liquor of the following composition (per liter): 3 g of a sodium salt of an alkyl-($C_{15}$)-sulfonic acid, 85 ml of hydrogen peroxide (35%), 45 ml of sodium hydroxide solution (30%) and 30 g of a preparation of 100 parts of the compound of the formula (2), 54 parts of magnesium chloride (hexahydrate), 155 parts of sodium gluconate and 691 parts of water. The fabric thus treated is rolled up, is packed air-tight into a plastic sleeve, and is stored at 25° C. for 24 hours. After this cold batching it is rinsed hot and cold and is washed at 98° C. for 20 minutes with a liquor which contains per liter 2 g of an ethoxylated nonylphenol. It is then rinsed hot and cold.

Dyeing c: dyeing b is repeated, except that the bleaching liquor used contains per liter 3 g of a sodium salt of an alkyl-($C_{15}$)-sulfonic acid, 85 ml of hydrogen peroxide (35%), 45 ml of sodium hydroxide solution (30%) and 30 g of a composition of 200 parts of the compound of the formula (2), 145 parts of magnesium chloride (hexahydrate), 155 parts of glucose and 500 parts of water.

Dyeings b and c have a brighter and more brilliant blue shade than dyeing a.

What is claimed is:

1. A process for treating unbleached cellulose fiber material comprising the steps of (i) dyeing said material with a vat, direct or reactive dye which is stable to the liquor used in step (ii) and subsequently (ii) bleaching and washing the dyed material in a liquor containing a bleaching agent and a stabilizer selected from the group consisting of (a) an adduct of an aminoalkanediphosphonic acid and an epihalogenohydrin, (b) a phosphonate oligomer, and (c) a reaction product of phosphorous acid and a carboxylic acid anhydride or halide, or a mixture of said stabilizers.

2. The process of claim 1, wherein the dye is a reactive dye.

3. The process of claim 1, wherein compound (a) is of the formula

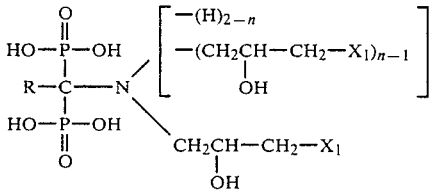

in which R is alkyl having 1 to 4 carbon atoms, $X_1$ is halogen, and n is 1 or 2.

4. The process of claim 3, wherein the adduct is in the form of an alkali metal salt.

5. The process of claim 1, wherein component (b) is of the formula

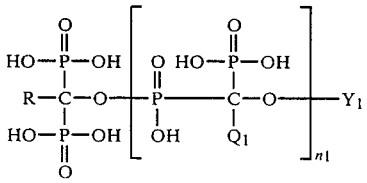

in which $Y_1$ is hydrogen or a radical of the formula $-COT_1$ in which $T_1$ is alkyl having 1 to 4 carbon atoms, R and $Q_1$ each are alkyl having 1 to 4 carbon atoms, and $n_1$ is an integer from 1 to 16.

6. The process of claim 5, wherein the oligomer is at least partly in the form of an alkali metal salt.

7. The process of claim 1, wherein the oligomer of component (b) is in the form of a magnesium complex.

8. The process of claim 7, wherein the molar ratio of oligomer to magnesium in the magnesium complex is 1:0.1 to 1:4.5.

9. The process of 1, wherein component (c) is a reaction product of phosphorous acid with an alkanecarboxylic anhydride or alkanecarbonyl halide having 2 to 4 carbon atoms in the alkane radical, in a molar ratio of 1:1–1.5.

10. The process of claim 9, wherein the reaction product is in the form of an alkali metal salt.

11. The process of claim 1, wherein the liquor of step (ii) further contains a polyhydroxy compound.

12. The process of claim 11, wherein the polyhydroxy compound is of the formula $$R_1-\left(\begin{array}{c}CH\\ |\\ OH\end{array}\right)_x-R_2$$

in which $R_1$ and $R_2$, independently of each other, are $-CH_2OH$, $-CHO$ or $-CO_2M$, M is hydrogen or an alkali metal, and x is 2 to 5.

13. The process of claim 12, wherein $R_1$ is $-CH_2OH$ and $R_2$ is $-CO_2M$.

14. The process of claim 8, wherein the liquor of step (ii) further contains a polyhydroxy compound and wherein the molar ratio of oligomer:magnesium:polyhydroxy compound is in the range of 1:(0.1–4.5):(0.1–10).

15. The process of claim 2, wherein the reactive dye contains, as a reactive group, an epoxy group, an ethyleneimino group, an isocyanate group, an isothiocyanate group, an acid radical having at least one halogen atom and/or a multiple bond capable of addition, or a radical of a halogenated aromatic nitrogen-containing ring.

16. The process of claim 15, wherein the reactive group is a β-chloropropionic acid group, or a β-bromopropionic acid group, an acrylic acid group, a methacrylic acid group, an α,β-dichloroacrylic acid group, an α,β-dibromoacrylic acid group, a halogenated pyrimidine group or a halogenated triazine group.

17. The process of claim 16, wherein the reactive group is a halogenated triazine group.

18. The process of claim 1, wherein step (ii) is carried out at 20° to 100° C. for 10 to 40 minutes.

19. The cellulose fiber material treated by the process of claim 1.

* * * * *